US006268832B1

(12) United States Patent
Twort et al.

(10) Patent No.: US 6,268,832 B1
(45) **Date of Patent: *Jul. 31, 2001**

(54) RADIO ANTENNA FOR VEHICLE WINDOW

(75) Inventors: Keith Jeremy Twort; John Davies, both of Stockport (GB)

(73) Assignee: BSH Industries Limited, Manchester (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/809,290

(22) PCT Filed: Sep. 28, 1995

(86) PCT No.: PCT/GB95/02308

§ 371 Date: Jun. 18, 1997

§ 102(e) Date: Jun. 18, 1997

(87) PCT Pub. No.: WO96/10275

PCT Pub. Date: Apr. 4, 1996

(30) Foreign Application Priority Data

Sep. 28, 1994 (GB) ..... 9419491

Jan. 23, 1995 (GB) ..... 9501268

(51) Int. Cl.[7] ..... H01Q 1/32

(52) U.S. Cl. ..... 343/713; 343/704; 343/711; 343/712

(58) Field of Search ..... 343/713, 704, 343/711, 712; H01Q 1/32

(56) References Cited

U.S. PATENT DOCUMENTS 5,640,167 * 6/1997 Hall ..... 343/713

* cited by examiner

*Primary Examiner*—Hoanganh Le
(74) *Attorney, Agent, or Firm*—Shoemaker and Mattare, Ltd.

(57) ABSTRACT

An antenna, particularly for use in VHF radio reception in a vehicle, is disclosed. The antenna is formed from an array of conductors which may constitute a window heating arrangement. The array has a receiving zone which is isolated from its surroundings by resonant isolating zones. These may be formed by interconnecting adjacent-heating elements which may be at a distance of 0.25λ of the wavelength (or multiple thereof) of the signal to be received from a real or virtual low-impedance connection to the vehicle structure.

30 Claims, 3 Drawing Sheets

RADIO ANTENNA FOR VEHICLE WINDOW

The present invention relates to antennas. The antennas to which this invention relates will most typically find application in a vehicle and can be used for VHF radio reception in the range of 76–110 MHz. However, antennas of the present invention may be used in other circumstances and other ranges (VHF otherwise) and are not restricted to use with audio broadcasts.

A motor vehicle, being a cage of metal, is internally largely shielded from external radio signals. It is thus necessary to provide an antenna for a radio receiver operating within the vehicle.

Traditionally, antennas for motor vehicles comprise a metal mast or rod which projects, in use, from the vehicle body. The disadvantages of these-have been long-recognised, such that technology has been available for many years whereby an antenna can be formed from conductive elements on a glass pane of the vehicle such as those used for rear-screen heating. Such antennas, in their broadest sense, will be referred to herein as window mounted antennas.

One reason why window mounted antennas are not universally used is that their cost is greater than the equivalent metal mast or rod antenna. This has not been due to the cost of providing a special glass pane; this is negligible. Rather, this has been due to the cost of the interface circuitry required. Most particularly, the interface circuitry has included active components for amplification of the signal received to a level suitable for feeding to a radio receiver.

An additional disadvantage of window mounted antennas (which conventionally include active components) is that the signal-to-noise ratio of the output from such antennas has not been as good as that of traditional mast types.

Various attempts have been made to improve the performance of window mounted antennas. These have included variations in the interface circuitry, changes to the pattern of conductive elements, and providing separate conductive elements dedicated to radio reception and which play no part in heating the window. However, these attempts have not removed the above disadvantages.

The primary aim of the present invention is to provide a window mounted antenna, particularly but not exclusively for VHF reception in cars, which has a lower cost and better performance than has hitherto been available.

In arriving at the present invention, the applicants have recognised that there has been acceptance that a window mounted antenna will be disadvantaged through being mounted within a conductive surround of uncontrolled behaviour at radio frequencies. A rear screen of a vehicle has properties similar to a slot, in a ground plane, but its resonance properties are uncontrolled and correspond only by coincidence with frequencies of signals to be received. Previously, attempts have been made to improve the signal derived from a disadvantageously disposed antenna. However, this has constituted an appeasement of the symptoms of inherent deficiencies rather than any attempt to remove them.

By the present invention, there is provided an antenna for receiving radio signals in a vehicle within a desired frequency range comprising an array of conductive elements disposed on a window pane, characterised in that the elements are disposed to define a radio reception zone between boundary conductive paths, each boundary conductive path being a part of a respective loop tuned to resonate at a frequency within the desired frequency range, the boundary conductive paths isolating the reception zone from the periphery of the pane to mitigate the effects on the receptor zone of image current flowing in the periphery of the aperture and such that the antenna is favourably matched to radio signals within the desired frequency range.

By realising that the antenna must be considered to act as a system in conjunction with its immediate surroundings, the applicants have been able to provide an antenna which generates from the outset signals which are of high quality. Particularly in the case of a metal vehicle the interaction between the antenna and the surrounding vehicle body is highly significant. In many embodiments, the signals can be of sufficient magnitude to be useable by a radio receiver without amplification.

Preferably, the elements are disposed such that a reception zone is created in the array which at least partially compensates for the effects of canceling image currents in the conductive material of the vehicle. In this manner, the reception zone can be configured as required to of-far high quality reception of signals. In such embodiments, a connection may conveniently be made to one or more elements within the reception zone from which connection an output signal is obtained.

In embodiments of the last-preceding paragraph, the reception zone may be defined between a pair of boundary conductive paths, each of which is part of a conductive loop tuned to resonate at a frequency within the desired reception range, Each of such loops advantageously has an external connection (for example, to a surrounding vehicle body) of low impedance at a frequency within the desired reception range. The external connection can, for example, comprise a series-resonant circuit, or an open-circuit $(1+2n)\lambda/4$ transmission line, to implement a short circuit at the frequency of operation. (Alternatively, a short circuit transmission time of $n\lambda/2$ may be used.) Such transmission lines have the advantage that they can be formed as a conductive path on the window pane. In any case, the connection advantageously is of high impedance to low frequencies and to DC.

Each boundary conductive path, as defined above, is preferably connected to the respective connection to the vehicle body through multiple conductive paths, these multiple paths each being of length approximately one quarter of the wavelength of a signal to be received while propagating within the window pane. These multiple paths are conveniently substantially parallel to one another and the boundary conductive path comprises elements interconnecting adjacent ones of the multiple paths.

The multiple paths are typically formed by heating elements for the window pant. In such embodiments, the boundary conductive path conveniently comprises a plurality of conductive elements interconnecting adjacent heating elements. In such embodiments, the interconnecting elements are advantageously disposed such that they interconnect points of substantially equal potential of the electrical heating supply. In this way, substantially no heating current will flow through them, allowing them to be formed as fine conductors.

In an antenna of the present invention, typically all of the conductive paths are formed by printing or deposition onto the pane.

In a second of its aspects, the invention provides a glass pane for a vehicle comprising an array of conductive elements disposed to constitute a heater for the pane and an antenna for receiving radio signals of a desired range of frequencies; the array comprising a plurality of parallel heating elements extending between a pair of bus bars, and a plurality of interconnecting elements each extending between adjacent heating elements, the interconnecting elements being disposed to be at a high impedance locus for signals in the desired range with respect to a connection point on one of the busbars.

Such a glass pane may be fitted to a motor vehicle during manufacture to provide that vehicle with an antenna for receiving radio broadcasts.

In a glass pane embodying the invention, the distance from a connection point along the conductive path defined by the busbars and the heating elements to each interconnecting element may typically be approximately one quarter of the wavelength of the signals of the desired frequency propagating within the glass pane, although other distances may be used and compensated for in the design. It is to be remembered that such signals will be propagating at a speed substantially less than (for example 60% of) their speed in free space.

The array of conductors typically includes an output conductive element connected to an approximately central part of one or more of the heating elements or two or more output elements that are later electronically combined. They may be symmetrically placed on the screen. A terminal may be connected to the output conductive element or combined conductive elements as the case may be, from which a signal is fed to a radio receiver. Additionally, the array may include a conductive strip extending form each connection point adjacent one or more edges of the pane to act as a transmission line. Moreover, there may be a further conductive element to constitute a capacitive coupling member which may typically comprise a T-shaped or L-shaped element connected to one of the heating elements, the crossbar of the T or L being disposed adjacent to an edge of the pane.

A glass pane embodying this aspect of the invention may comprise a conductive strip constituting a phase adjustment member operative to concentrate the net signal currents in the centre of the screen.

The busbars of a glass pane as defined above are advantageously tuned to resonate within the desired frequency range.

In a third of its aspects, the invention provides a vehicle incorporating a pane of glass according to the second aspect of the invention for use as a radio antenna.

In a fourth of its aspects, the invention provides an antenna for receiving broadcast VHF radio signals in a vehicle the antenna comprising:

an array of conductive elements formed an a window pane of the vehicle, the array comprising first and second busbars extending close to respective opposite edges of the pane;

a plurality of generally parallel, spaced-apart heating elements interconnecting the busbars;

characterised by a respective connection of low impedance to the received radio signals from each busbar to electrically-conductive material of the vehicle surrounding the window pane;

by a plurality of interconnecting elements each interconnecting element extending between adjacent heating elements, the interconnecting elements being approximately in two curved loci each disposed around a respective one of said connections of low impedance, and each locus being defined by the path length from the respective connection of low impedance, along the busbar to which that connection is made, and thence along each heating element to the interconnecting element being a distance of $\lambda/4+n\lambda/2$) where $n \geqq 0$ and $\lambda$is the wavelength of a signal to be received while that signal is propagating within the window pane;

and by a T-shaped or L-shaped element connected to one of the heating elements, she crossbar of the T or L being disposed adjacent an edge of the pane.

Embodiments of the invention will now be described in detail, by way of example, with reference to the accompanying drawings in which.

Figure 1:
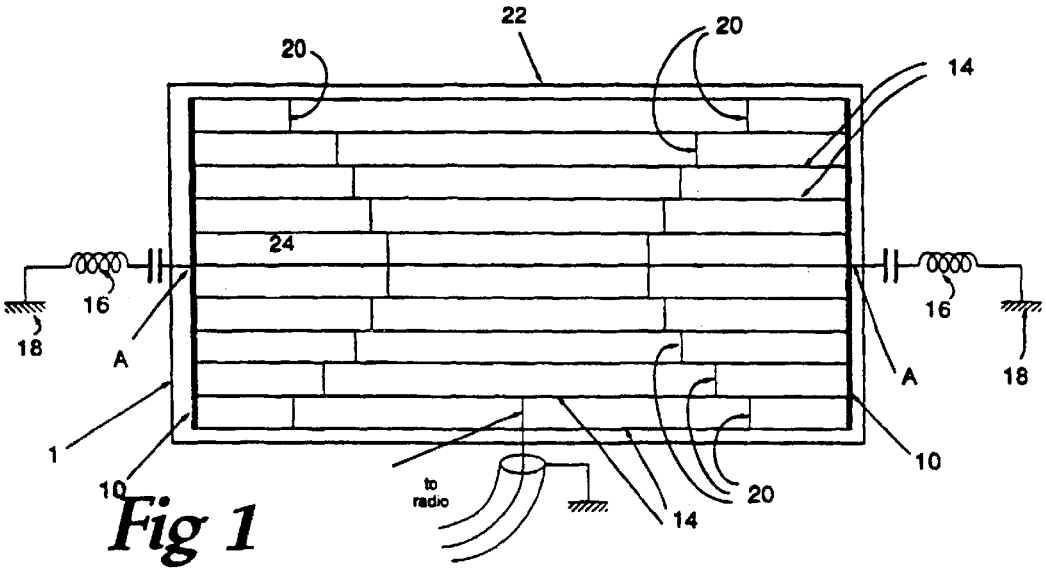
FIG. 1 shows a rear screen heater for a car incorporating an antenna embodying the invention.

With reference to FIG. 1, an embodiment of the invention comprises a glass rear screen 1 (known in the art as "a heated backlite") for a car on which an array of conductive elements is formed in a manner conventionally used to form a rear screen heater.

The array comprises a pair of busbars 10 which are generally parallel and spaced apart to be disposed adjacent to opposite edges of the screen 1. The busbars 10 are interconnected by a multiplicity of heating elements 14, these being generally parallel and meet the busbars at a regular spacing. A DC voltage derived from the electrical system of the vehicle can, by means of a user control, be selectively applied across the busbars 10, this causing a heating current to flow in the heating elements 14, with the effect of clearing frost or mist from the screen 1. As thus far described, the array constitutes a conventional heated screen arrangement.

In accordance with the present invention, the structure also operates as an antenna for receiving radio transmissions within a desired frequency range, in this embodiment, the VHF range of 67–110 MHz.

Each busbar 10 is connected at a respective point A to the vehicle body through a path of low impedance to signals within the desired frequency range. With this embodiment, such connection is made through a series-resonant circuit 16, comprising a series-connected capacitor and inductor, to the vehicle body at 18. The series-resonant circuit is tuned to resonate within the desired frequency range, such that the series-resonant circuit 16 provides a low-impedance path to the vehicle body for signals of such frequencies, but is effectively open-circuit for DC signals.

A series of interconnecting conductive elements 20 are provided which interconnect adjacent heating elements 14. The interconnecting elements 20 are disposed such that they interconnect points on the heating elements which are of a distance traced along a conductive path of typically $0.25\lambda$ from the point A of a busbar 10. Where a low-impedance connection at the frequency of operation is implemented to the aperture periphery, this is typically the point at which DC power is supplied to the heater, and symmetrically the point at the DC path to the vehicle earth. As used herein, $\lambda$ is the wavelength of signals to be received as they propagate in the glass pane. (It is to be remembered that radio signals propagate in conductive tracks printed on glass by a typical factor of 0.6 of their speed in free space, their wavelength being shortened accordingly.) Thus, as shown in FIG. 1, the interconnecting elements 20 are disposed on two loci, each centred on a respective point A.

The interconnecting elements 20 are disposed transversely to the heating elements 14 so as to interconnect points of substantially equal DC potential arising from the heating current. In this way substantially no current flows through them, so minimising their interference with the heating effect of consequent interference with vision) to be minimised.

Each point A has associated with it a respective plurality of interconnecting elements 20, This divides the entire array into three regions, the centre of which 22 constitutes a receiving zone for signals of the desired frequency. The closed loop provided from each point A, through the interconnecting elements is a half-wave resonant structure. It has been found that the structure of the outer zones 24 serves to isolate the receiving zone 22 from the effects of the surrounding vehicle, allowing it to operate substantially as a slot antenna.

An output conductive element 26 is connected to a centre point on two of the lowermost heating elements 14. The output element 26 is connected to a suitable terminal at which connection is made to a co-axial feed wire 28 to carry a received radio signal to a radio receiver.

Figure 2:
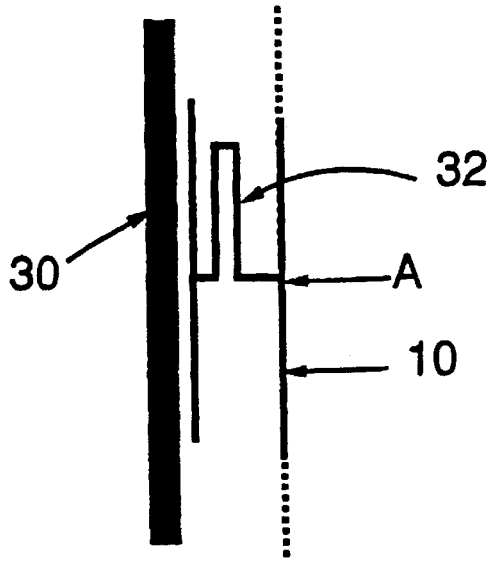
FIGS. 2 and 3 are respectively first and second alternative arrangements for a low-impedance connection for earthing points in embodiments of the invention.

With reference to FIG. 2, a first alternative to the series-resonant circuit described above is shown, this having the advantage of needing no discrete components. In this arrangement, a conductive strip connected to the vehicle body 30 is provided surrounding the screen. A series resonant circuit is a constituted by a resonant conductive element formed as part of the array connected to the busbar at a point A. The resonant strip comprises a first region 32 which is convoluted to form an inductor, and a second T-shaped capacitive region 34 lying adjacent the earthed strip 30, to be capacitively coupled therewith.

In this embodiment, the earthed strip 30 is not strictly necessary, it being possible to capacitively couple directly with the vehicle body instead. However, it has been found that this is difficult to control, particularly where a screen is secured to the vehicle by means of adhesive, the presence of adhesive between the capacitive region 34 and the vehicle body substantially increasing the effective resistive loss associated with the reactance of the capacitance.

Figure 3:
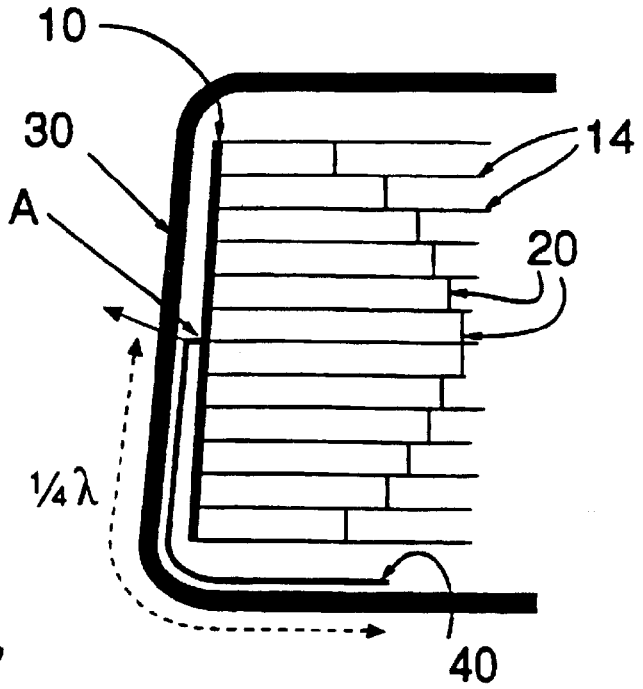

A further alternative to the series-resonant circuit described with reference to FIG. 1 is shown in FIG. 3, which is potentially more space-efficient than the embodiment described in the last-preceding paragraph. In this embodiment, there is provided connected to an earthing point A, a conductive element 40 which constitutes a transmission line. This is disposed to extend for a length of $0.25\lambda$, or $0.25\ (1+2n)\lambda$where n is a positive integer, adjacent the vehicle body or a peripheral strip 30, as described above. This arrangement constitutes a tuned stub which is effectively a short circuit for those signals to which it is tuned.

Figure 4:
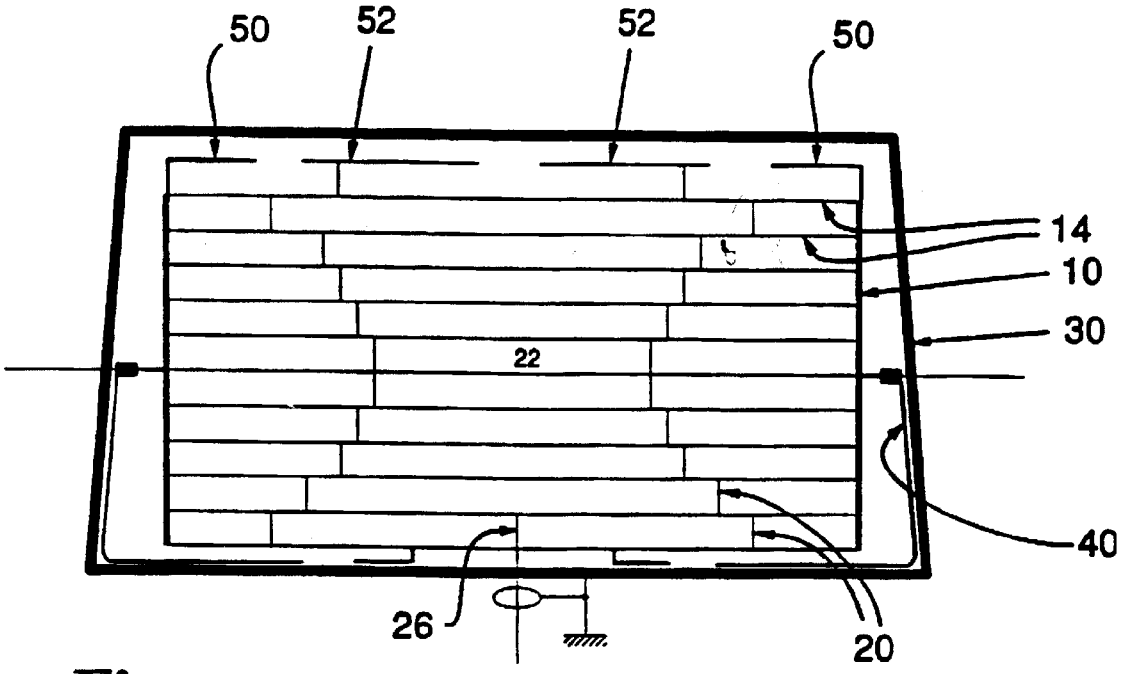
FIG. 4 shows a rear screen for a vehicle being a second embodiment of the invention.

With reference to FIG. 4, there are various enhancement a which can an be made to optimise the performance of antennas embodying the invention, For example, it is desirable that the output from the antenna as closely as possible matches the input impedance of the radio receiver, typically 120Ω.

Firstly, it may be desirable to tune the busbars 10 to resonate close to the centre of the desires range of frequencies. This can be achieved by extending them as shown at 50.

Optimisation can be further enhanced by providing capacitive coupling elements, such as those shown at 52, to couple the receiving zone 22 to its surroundings. Furthermore, elements ouch as those shown at 54 can be provided to adjust the phase of the signals within the receiving zone and so reduce losses due to circulating currents which may occur in the lower heating elements which are interconnected by the output element 26.

Figure 5:
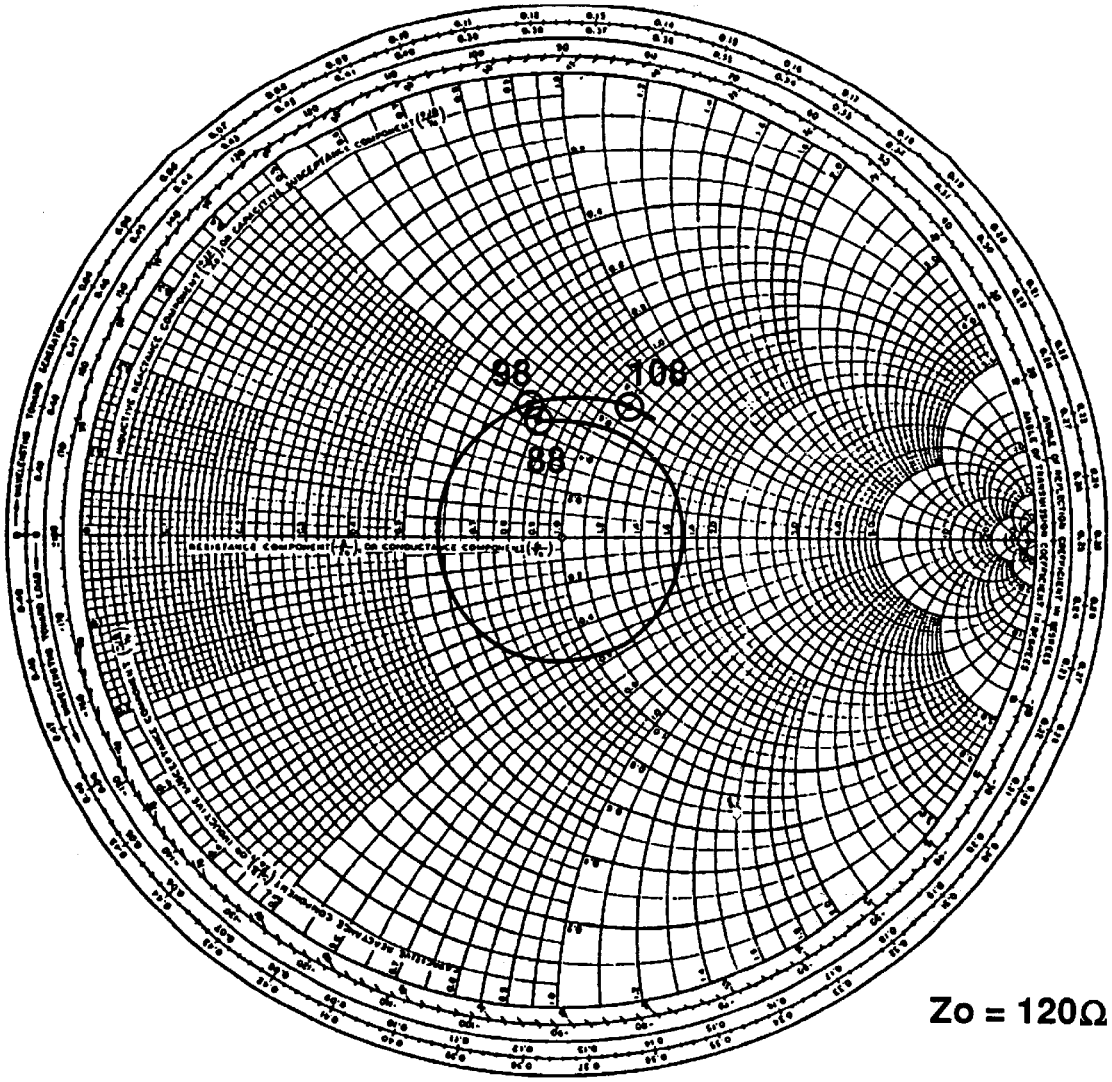
FIG. 5 is a Smith chart of the performance of the antenna of FIG. 4.

The Smith chart of FIG. 5 shows the high standard of performance achievable with this embodiment normalised to 120Ω.

It will be appreciated that many variations are possible within the scope of the invention, as defined in the following claims. For example, it is possible for a signal to be taken from the receiving zone 22 through one or more additional connections, or by inductive or capacitive couplings, Diversity reception is possible using embodiments of the present invention in true orthogonal modes of resonance.

Additionally, it will be appreciated that the physical point at which connection is made to the busbar 10 may not coincide with the point A. By use of suitable networks, these may be moved from point A while still retaining a low-impedance coupling at the aperture edge at this point the coupling being an image of the complex impedance presented at the connection point.

What is claimed is:

1. An antenna for receiving radio signals in a vehicle within a desired frequency range comprising an array of conductive elements disposed on a window pane, wherein the elements are disposed to define a radio reception zone between boundary conductive paths, each boundary conductive path being a part of a respective loop turned to resonate at a frequency within the desired frequency range, the boundary conductive paths isolating the reception zone from the periphery of the pane to mitigate effects on the reception zone of image current flowing in the periphery of a window aperture.

2. An antenna according to claim 1, wherein each said loop has an external connection of low impedance at a frequency within the desired frequency range to the vehicle body at the window aperture.

3. An antenna according to claim 2, wherein each said connection to the vehicle body comprises a series resonant circuit.

4. An antenna according to claim 3, wherein each said connection to the vehicle body comprises a transmission he configured to produce a short circuit across the connection at a frequency of signals to be received.

5. An antenna according to claim 4, wherein said transmission fine comprises a conductive path disposed on the window pane adjacent the edge of the window pane.

6. An antenna according to claim 2, wherein the connection to the vehicle body has a high impedance to low-frequency signals.

7. An antenna according to claim 2, wherein each boundary conductive path is connected to the respective connection to the vehicle body through multiple conductive paths, these multiple paths each being of length $\lambda/4+n(\lambda/2)$ where $n \geqq 0$ and $\lambda$ is the wavelength of a signal to be received while that signal is propagating within the window pane.

8. An antenna according to claim 2, wherein each boundary conductive path is connected to the vehicle body through multiple conductive paths, these multiple conductive paths being of such a length as to produce an image of a high-impedance locus equivalent to $\lambda/4$ from the respective low impedance connection point where $\lambda$ is the wavelength of a signal to be received while that signal is propagating within the window pane.

9. An antenna according to claim 2, wherein each boundary conductive path defines a locus of equal distance for a signal propagating within the window pane from the low impedance points on the respective sides of the heated rear window of a vehicle.

10. An antenna according to claim 9, wherein the multiple paths are substantially parallel to one another and the boundary conductive path comprises elements interconnecting adjacent ones of the multiple paths.

11. An antenna according to claim 10, wherein the boundary conductive path comprises a plurality of conductive elements interconnecting adjacent heating elements.

12. An antenna according to claim 11, wherein the boundary conductive path comprises a plurality of conductive elements interconnecting adjacent heating elements.

13. An antenna according to claim 12, wherein the interconnecting elements are disposed such that they interconnect points of substantially equal potential of the electrical heating supply.

14. An antenna according to claim 1, adapted to receive VHF radio signals.

15. An antenna according to claim 1, wherein said matching is effective over a bandwidth of frequencies to be received.

16. An antenna according to claim 1, wherein a connection is made to two elements within the reception zone from which connection an output signal is obtained.

17. An antenna according to claim 11, wherein all of the conductive paths are formed by printing or deposition onto the pane.

18. An antenna according to claim 1, wherein the pane is a window mounted in an aperture of a vehicle body.

19. An antenna according to claim 18, wherein the array of conductive elements includes tuning element arranged to fink the array capacitively to the vehicle body by means of which the resonance of the array and vehicle body system can be tailored to suit the signals to be received.

20. A glass pane for a vehicle comprising an array of conductive elements forming both a heater for the pane and an antenna for receiving radio signals of a desired range of frequencies, said array comprising a plurality of parallel heating elements extending between a pair of busbars, and a plurality of interconnecting elements each extending between adjacent heating elements, the interconnecting elements being disposed at high impedance, loci for signals in the desired range with respect to a connection point on one of the busbars.

21. A glass pane according to claim 20, wherein the distance from a connection point along the conductive path defined by the busbars and the heating elements to each interconnecting element is approximately an odd multiple of one quarter of the wavelength of the signals of the desired frequency propagating within the glass pane.

22. A glass pane according to claim 20 wherein the array includes an output conductive element connected to an approximately central part of at least one of the heating elements, a terminal being connected to the output conductive element from which a signal is fed to a radio receiver.

23. A glass pane according to claim 20, wherein me array includes a output conductive strip extending from each connection point adjacent at least one edge of the pane to act as a transmission line.

24. A glass pane according to 20 further comprising a conductive element arranged to constitute a capacitive coupling, member.

25. A glass pane according to claim 24, wherein the capacitive coupling member comprises a T-shaped or L-shaped element connected to one or more of the heating elements, the crossbar of the T or L being disposed adjacent an edge of the pane.

26. A glass pane according to claim 20, further comprising a conductive strip constituting a phase adjustment member operative to optimize signal currents in the center portion of the screen thus minimizing the effect of deleterious image currents in the material of the vehicle body.

27. A glass pane according to claim 20, wherein the busbars are tuned to resonate within said frequency range.

28. A glass pane according to claim 27, wherein each of the bus bars has an associated plurality of interconnecting elements.

29. A vehicle incorporating a pane of glass according to claim 20.

30. An antenna for receiving broadcast VHF radio signals in a vehicle, said antenna comprising:

an array of conductive elements formed on a window pane of the vehicle, the array comprising first and second busbars, extending close to respective opposite edges of the pane;

a plurality of general parallel, spaced-apart heating elements interconnecting the busbars;

a respective connection of low impedance to the received radio signals from each busbar to electrically-conductive material of the vehicle surrounding the window pane; pane;

a plurality of interconnecting elements each interconnecting element extending between adjacent heating elements, the interconnecting elements being approximately in two curved loci each disposed around a respective connection of low impedance, and each locus being defined by the path length from the respective connection of low impedance, along the busbar to which that connection is made, and thence along each heating elements to the interconnecting element being a distance of $\lambda/4+n(\lambda/2)$ where $n \div 0$ and $\lambda$ is the wavelength of a signal to be received while that signal is propagating within the window pane; and a T-shaped or L-shaped element connected to one of the heating elements, the crossbar of the T or L being disposed adjacent an edge of the pane.

* * * * *